US007439468B2

(12) United States Patent
Cartal et al.

(10) Patent No.: US 7,439,468 B2
(45) Date of Patent: Oct. 21, 2008

(54) METHOD OF SORTING POSTAL ITEMS WITH PREDICTIVE MANAGEMENT OF SORT-OUTLET TRAY REPLACEMENT

(75) Inventors: Bruno Cartal, Rockville, MD (US); Karim Kara, Chabeuil (FR)

(73) Assignee: Solystic, Gentilly Cedex (FR)

( * ) Notice: Subject to any disclaimer, the term of this patent is extended or adjusted under 35 U.S.C. 154(b) by 132 days.

(21) Appl. No.: 11/431,593

(22) Filed: May 11, 2006

(65) Prior Publication Data

US 2006/0259186 A1 Nov. 16, 2006

(30) Foreign Application Priority Data

May 13, 2005 (FR) ..... 05 51258

(51) Int. Cl.
*B07C 5/00* (2006.01)

(52) U.S. Cl. ..... 209/584; 209/900; 700/223

(58) Field of Classification Search ..... 209/583, 209/584, 900; 700/223–227
See application file for complete search history.

(56) References Cited

U.S. PATENT DOCUMENTS 3,573,748 A * 4/1971 Holme ..... 209/584
5,414,974 A 5/1995 Van de Ven et al.
5,901,855 A * 5/1999 Uno et al. ..... 209/584
6,316,741 B1 * 11/2001 Fitzgibbons et al. ..... 209/584
6,881,916 B2 * 4/2005 McLaughlin et al. ..... 209/584
7,170,024 B2 * 1/2007 Burns et al. ..... 209/584
2002/0125177 A1 9/2002 Burns et al.
2003/0141226 A1 * 7/2003 Morikawa ..... 209/584
2006/0219611 A1 * 10/2006 Madar et al. ..... 209/584

FOREIGN PATENT DOCUMENTS

WO WO 01/23108 4/2001

* cited by examiner

*Primary Examiner*—Joseph C Rodriguez
(74) *Attorney, Agent, or Firm*—Sughrue Mion, PLLC

(57) ABSTRACT

A method of sorting postal items in a plurality of sorting passes in a sorting machine having sort outlets with removable trays, the method including the steps of: (i) after a first sorting pass during which the sorted items are stored in the trays, determining and storing in a memory the pass sequence in which the items are to pass through the sorting machine for the subsequent sorting pass; and (ii) during said subsequent sorting pass, while a current item to be directed towards a sort-outlet tray is passing, determining in the pass sequence the difference in rank between the current item and a next item immediately following the current item and that is to be directed to the same sort-outlet tray as the current item, and comparing the difference with a threshold for causing the sort-outlet tray to be replaced with an empty tray.

6 Claims, 3 Drawing Sheets

METHOD OF SORTING POSTAL ITEMS WITH PREDICTIVE MANAGEMENT OF SORT-OUTLET TRAY REPLACEMENT

The present invention relates to a method of sorting postal items in a plurality of passes in a sorting machine, in particular a bin carrousel sorting machine, having sort outlets with removable trays for storing the sorted items.

BACKGROUND OF THE INVENTION

During a sorting process, the sorted postal items are stored in the sort-outlet trays, and when a sort-outlet tray is full, the full tray is replaced with an empty tray by means of an automatic tray change system that is, for example, part of an Automated Tray Handling System (ATHS).

While a full tray is being replaced with an empty tray, the corresponding sort outlet is unavailable for the sorted items, the time for which it is unavailable being approximately a few seconds (about 5 seconds). The overflow items that ought to have been directed to that sorting outlet while the full tray is being replaced must be recycled on the bin carousel.

Recycling said postal items uses up bins of the carrousel and is detrimental to the operating throughput of the sorting machine.

If postal items are recycled while postmen's walks are being prepared, that results in the order (sequence) of the items being lost, and such postal items must therefore be directed towards a reject outlet for manual sorting, which gives rise to considerable extra handling costs.

Techniques for overflow management of sort-outlet trays are already known that consist in providing two trays per sort outlet and in causing them to operate alternately. However, those techniques require a complicated tray handling system.

OBJECTS AND SUMMARY OF THE INVENTION

An object of the invention is to propose a solution for managing situations in which a full tray is replaced with an empty tray that is simple and that preserves the operating throughput of a bin carrousel of a sorting machine.

To this end, the invention provides a method of sorting postal items in a plurality of sorting passes in a sorting machine having sort outlets with removable trays for storing the items, said method comprising the following steps, consisting:

after a first sorting pass during which the sorted items are stored in the trays, in determining and storing in a memory the pass sequence in which the items are to pass through the sorting machine for the subsequent sorting pass; and during said subsequent sorting pass, while a current item to be directed towards a sort-outlet tray is passing, in determining in said pass sequence the difference in rank between the current item and a next item immediately following the current item and that is to be directed to the same sort-outlet tray as the current item, and in comparing said difference with a threshold for causing said sort-outlet tray to be replaced with an empty tray.

With the method of the invention, a full bin is replaced with an empty bin early, i.e. before a tray overflow situation is reached.

The method of the invention further presents the following features:

during the subsequent sorting pass, the difference in rank between the next item following the current item and an item immediately following the next item and that is to be directed to the same sort-outlet tray as the current item or as the next item is determined, and said difference is compared with said threshold for causing said sort-outlet tray to be replaced with an empty tray;

during the first sorting pass, the thickness of each item is measured and recorded, and, during the subsequent sorting pass, the filling levels in the trays are monitored on the basis of the thickness data;

the filling level of a sort-outlet tray is determined while the current item is passing and if the filling level is greater than a first threshold (S1), the sort-outlet tray is caused to be replaced with an empty tray, and if the filling level is greater than a second threshold (S2) that is less than the first threshold, the difference in rank between the current item and the next item following the current item in the pass sequence is determined; and the filling level of the tray with the next item following the current item is determined, and said filling level is compared with a third threshold (S3) that is greater than the first threshold (S1) so as to cause said sort-outlet tray to be replaced with an empty tray.

The invention also provides a postal sorting machine arranged to implement the above-described method.

BRIEF DESCRIPTION OF THE DRAWINGS

The invention will be better understood on reading the following description and on examining the accompanying figures. The description is given merely by way of indication and is not in any way limiting on the invention.

In the figures.

MORE DETAILED DESCRIPTION

Figure 1:
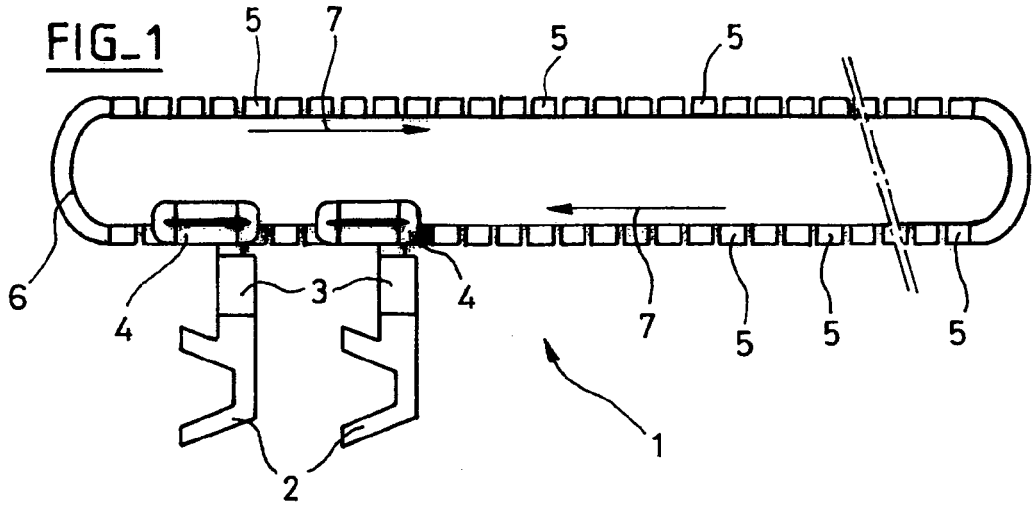
FIG. 1 is a very diagrammatic view of a postal sorting machine having a bin carrousel arranged for implementing the method of the invention.

FIG. 1 shows a postal sorting machine 1 with two inlet and unstacker devices 2 which put postal items in series so as to convey them on edge towards devices 3 for automatic address recognition by optical character recognition (OCR), for video encoding, or for reading bar codes. The postal items are then injected into the bins of an injection carrousel 4, and then injected into the bins 5 of a carrousel 6 that travels in the direction indicated by arrow 7 above a plurality of sort outlets provided with removable trays (not shown). Each bin 5 normally conveys a single postal item to a sort outlet. In the invention, in addition, the filling levels of the sort-outlet trays 5 are monitored on the basis of measurement of the thickness of each item, it being possible for this thickness measurement to be taken in the device 3.

Figure 2:
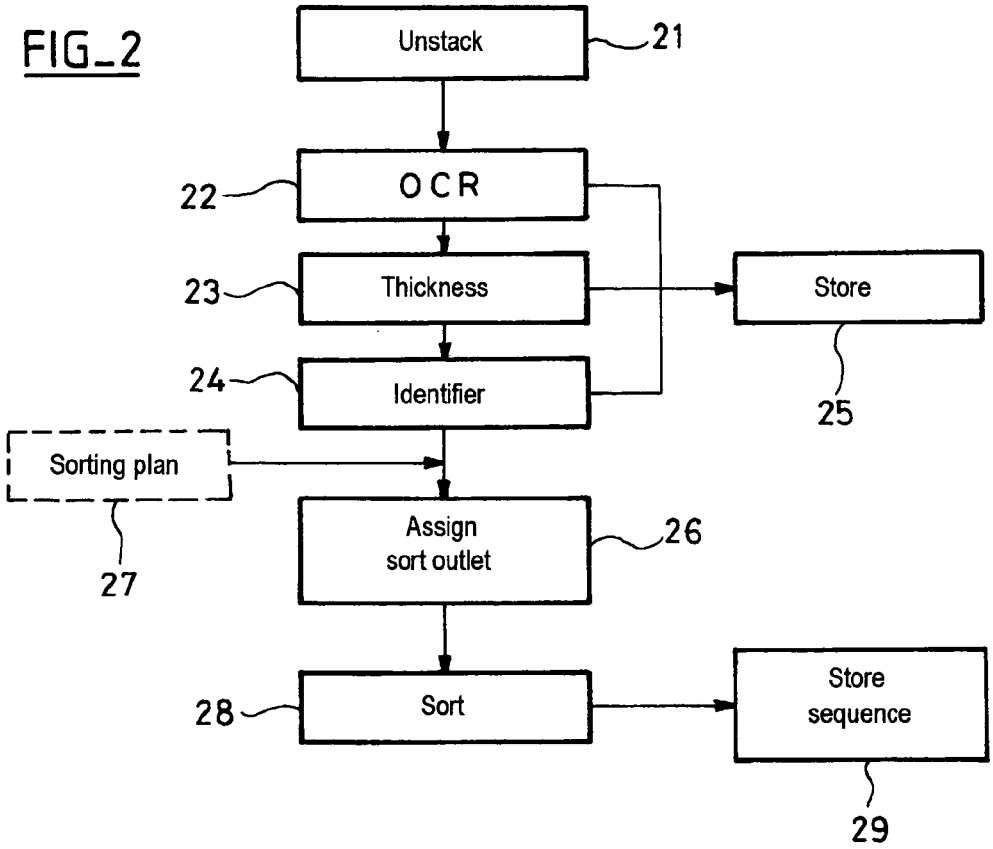
FIG. 2 is a flow chart showing the various steps of a first sorting pass of a method of the invention for sorting postal items.

FIG. 2 shows the various steps of a first sorting pass of the invention.

The postal items are unstacked one-by-one in step 21. For a current item, in the device 3, the address of the item is determined (step 22), e.g. by OCR on the basis of an image of the item that contains the address information, the thickness of the item is measured (step 23), and a logic identifier is assigned to the item (step 24) and said identifier is, for example, printed in the form of a bar code on the surface of the item. The measurement of the thickness of the item can be performed by any conventional means known per se.

The address, the thickness, and the logic identifier associated with the current item are recorded in correspondence with one another in a memory in step 25.

In step 25, a logic destination corresponding to a sorting outlet is determined on the basis of a sorting plan 27 and of the address of the item. The logic destination corresponds, for example, to an outward sorting point, to a delivery point of a postman's walk, or indeed to a set of delivery points or to a set of outward sorting points.

The current item is then directed (step 28) towards the corresponding sort outlet so as to be stored in the tray of said sort outlet and, in step 29, the logic identifier of the item is recorded in correspondence with the sort outlet and/or with the sort-outlet tray in which it is stored so that, after this first sorting pass, it is possible to determine the sequence in which the items are to pass through the sorting machine for the second sorting pass, the sequence being based on the sorting plan of the second sorting pass. This item pass sequence for the second sorting pass is recorded in a memory in step 29.

At the end of the first sorting pass, the trays containing the postal items are conveyed to the inlet of the sorting machine for the second pass while keeping a certain order, dictated by the second pass sorting plan. The full trays can be conveyed automatically to the inlet of the machine.

Figure 3:
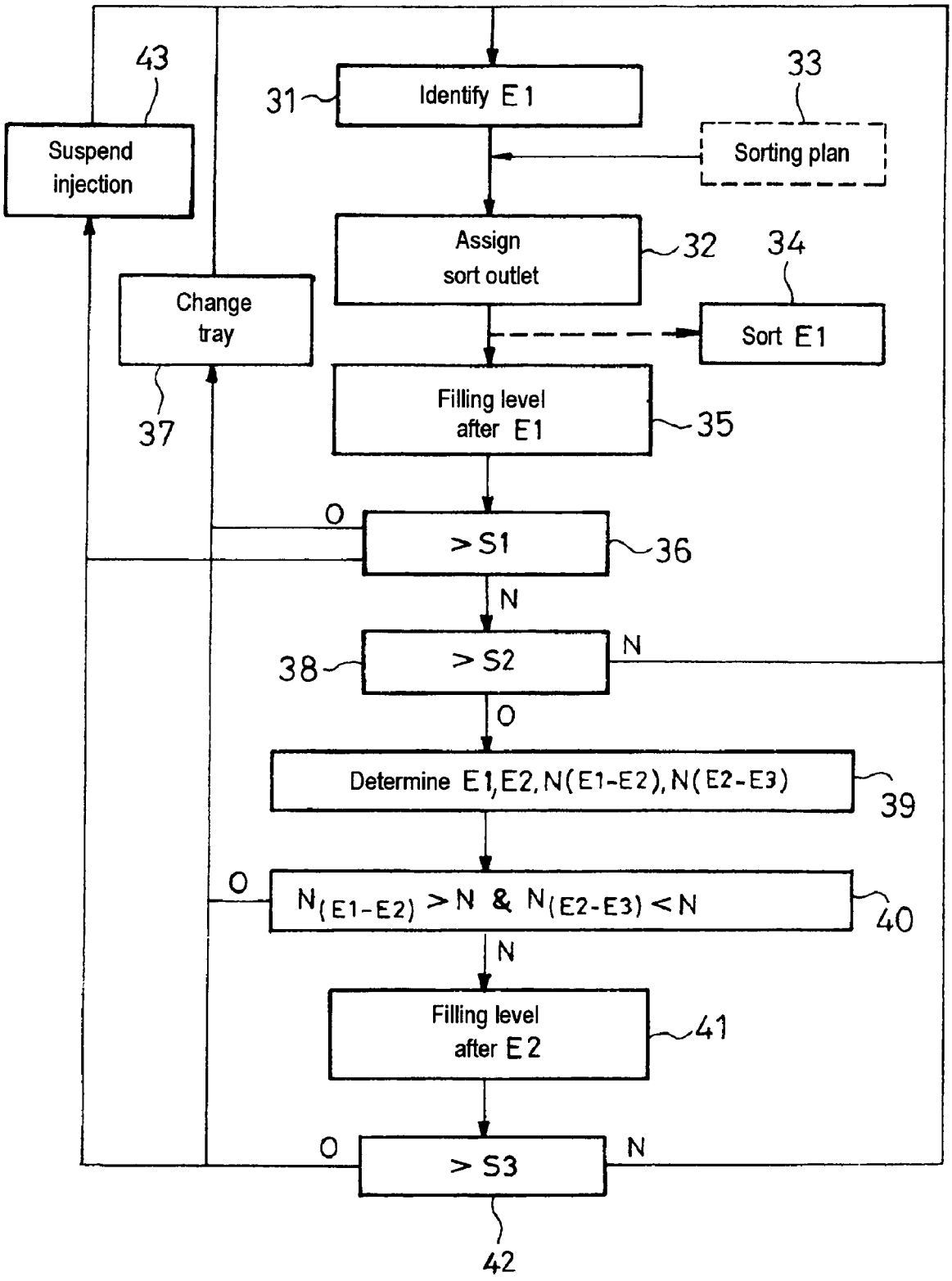
FIG. 3 is a flow chart showing various steps of a second sorting pass of a method of the invention for sorting postal items.

FIG. 3 shows the various steps of the second sorting pass of the method of the invention.

In step 31, the logic identifier E1 of a current item is read, e.g. by means of a bar code reader, and the address and the thickness of the item are retrieved from the memory. In step 32, a sorting outlet is assigned to the current item on the basis of the second pass sorting plan 33, and of the address of the current item.

In step 34, the current item E1 is directed by the bin carrousels 4 and 6 towards the sort outlet that was assigned to it in step 32 so as to be stored in a tray of said sort outlet.

In the invention, the filling level of the corresponding sort-outlet tray 5 is monitored.

In step 35, the filling level of the tray is determined after the current item E1 has been stored therein. The filling level is obtained by summing the pieces of thickness information recovered each time a current item assigned to the tray in question passes.

In step 36, the filling level determined in step 35 is compared with a first threshold S1 whose value is set to correspond to a filling level beyond which a change of tray must be caused to take place. If the determined filling level is greater than S1, the full tray in the corresponding sort outlet is caused to be replaced with an empty tray in step 37 after the current item E1 has been stored in the full tray, and the process continues at step 31 for a new current item.

If the filling level determined at step 35 is less than S1, the same filling level is compared, in step 38, with a second filling threshold S2 which is less than S1. The value of S2 is set to correspond to a filling level from which it is conceivable to change the tray in order to prevent it from overflowing in the sort outlet, even if the tray is not completely full. If the filling level is less than S2, the process continues at step 31 for a new current item.

If the filling level is greater than S2, it is determined whether a tray change can be performed under optimum conditions.

Below, reference E2 designates that next item immediately following the current item E1 in the pass sequence of the items in the second pass which is to be directed to the same sort-outlet tray as the current item E1. Reference E3 designates that item immediately following said next item E2 in the pass sequence of the items in the second pass which is to be directed to the same sort-outlet tray as the current item E1 or as the next item E2.

In step 39, the difference in rank in the pass sequence stored in a memory in step 29 between item E1 and item E2 (indicated by $N_{(E1\text{-}E2)}$) is determined, as is the difference in rank between item E2 and item E2 (indicated by $N_{(E2\text{-}E3)}$). The term "difference in rank" is used to mean the number of items interposed between the items E1 and E2 or between the items E2 and E3 in the pass sequence of the items.

In step 40, these differences are compared with a threshold value N. More particularly, if $N_{(E1\text{-}E2)}$ is greater than N and if $N_{(E2\text{-}E3)}$ is less than N, the tray at the sort outlet is caused to be replaced with an empty tray (step 37) after the current item E1 has been deposited in the full tray. The value N is set so as to correspond to the time necessary for performing a tray change in a sort outlet. In step 40, predictive management of the tray change is thus performed. If the answer to the test in step 40 is "no", the process continues at 41.

In step 41, the filling level in the sort-outlet tray is determined early by adding the thickness of the item E2 that is stored in a memory in step 25. In step 42, the filling level (determined in step 41) is compared with a third threshold S3 that is greater than S1. If the filling level is greater than the maximum filling threshold S3 for the tray, the tray in the sort outlet is caused to be changed (step 37) after the current item E1 has been deposited in it. Otherwise, the process continues at step 31 for a new current item.

When a tray change is performed pursuant to steps 36 and 42, it is possible for the sort outlet tray to be in an overflowing state. In which case, in the method of the invention, it is possible to suspend injection of the items into the injection carrousel momentarily at step 43. The suspension time for which the injection is suspended can be adjusted as a function of the number $N_{(E1\text{-}E2)}$ and of the tray change time required for changing a sort-outlet tray. The suspension time for which the injection is suspended is, for example, inversely proportional to $N_{(E1\text{-}E2)}$. The suspension can be effected only if the suspension time is short enough to generate an advantage greater than rejecting the item.

Alternatively, in order to avoid suspending the unstacking of the items, it is possible to direct the item to a reserve or overflow outlet.

It is also possible, jointly with step 39, to compute the filling level of the tray if all of the items of the second pass are sorted. If said filling level does not exceed the maximum filling threshold S3 of the tray, it is not necessary to change the tray and the process continues at step 31 for a new current item.

Figure 4:
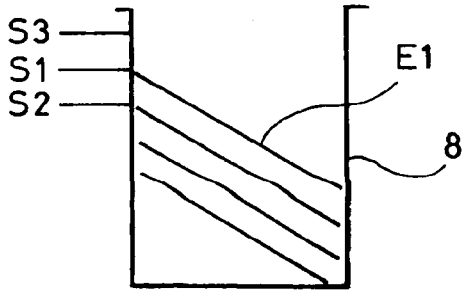
FIG. 4 shows the thresholds for monitoring the filling levels of the sort-outlet trays.

FIG. 4 shows the filling thresholds S1, S2, and S3 for a sort-outlet tray 8 with the current item E1. The filling threshold S2 is less than the filling threshold S1 which is itself less than the filling threshold S3.

The threshold S3 corresponds to the maximum filling level for the tray, i.e. the filling threshold than cannot be exceeded, and thus, if it is computed that the filling level after deposition of an item exceeds said threshold S3, said item cannot be received in said tray. The threshold S1 corresponds to a predetermined limit for taking the decision that a tray is full, i.e.

when it is computed that, after deposition of an item, said threshold is exceeded, it is decided that said tray can no longer receive items after that item has been stored in it. Therefore, the threshold S3 is reached only when it is desired to deposit an item that is very thick (thicker than the difference in height between S3 and S1) since, otherwise, the threshold S1 would have been crossed prior to that. The threshold S2 corresponds to a filling level at which the tray is partially full, that filling level being considered to be sufficient so that, once it is exceeded, it is possible to take the decision to change it so as to avoid an overflow. Thus, once the threshold S2 is exceeded, an attempt is made to determine the best moment for changing the tray. Once this threshold is exceeded, it is more advantageous for the tray not to overflow than it is to fill the tray to the maximum extent. Finally, the threshold N corresponds to the number of items that have had time to be sorted in the sorting machine while a tray change is taking place. A tray change that lasts 5 seconds is equivalent to a value of N equal to 50.

Figure 5:
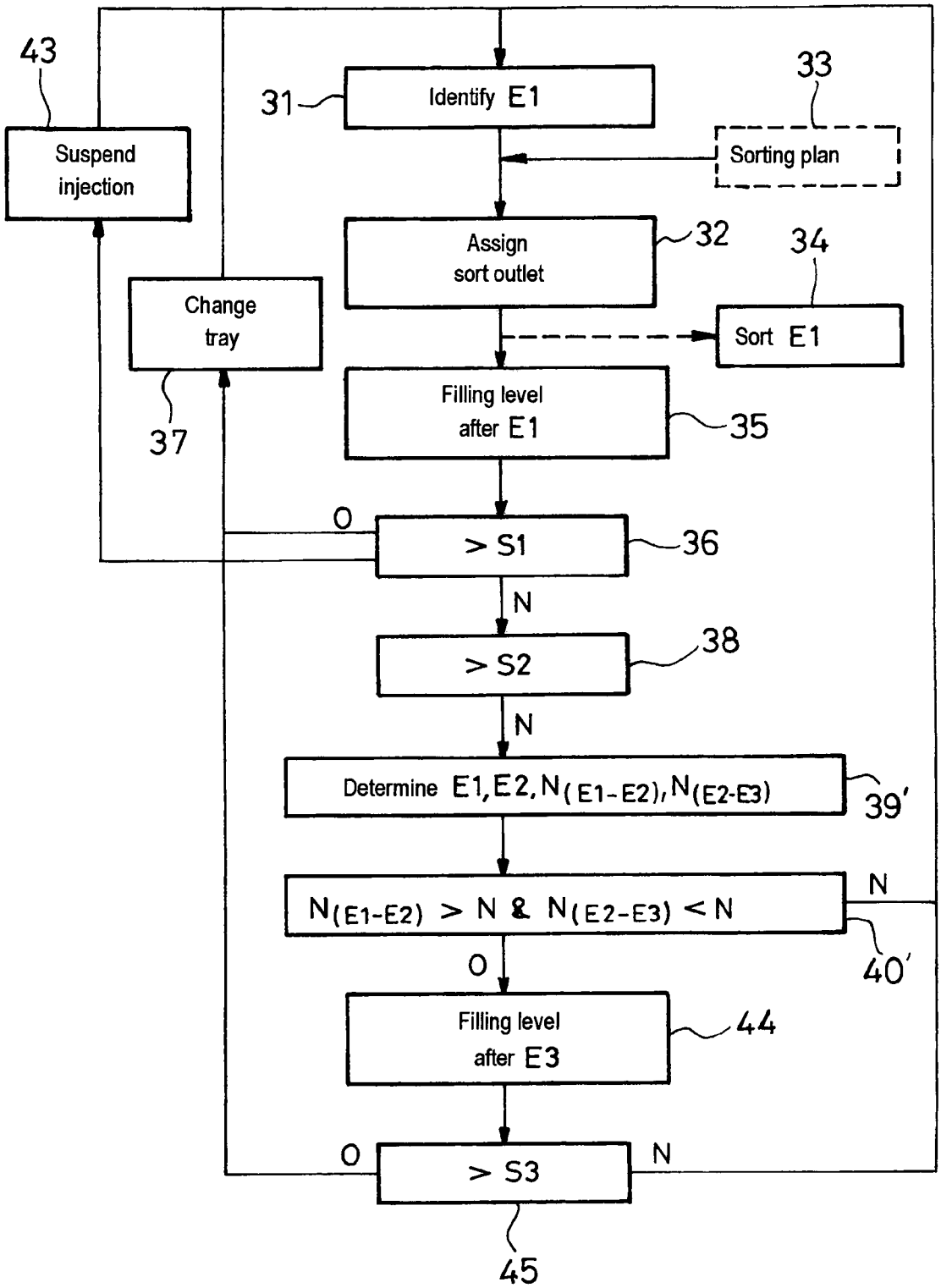
FIG. 5 is a flow chart showing various steps of a particular implementation of the second sorting pass of the method of the invention.

FIG. 5 shows a variant of the method of the invention when the filling level of the tray is less than the threshold S2 at step 38. In which case, in step 39', the difference in rank in the pass sequence stored in a memory in step 29 between item E1 and item E2 (indicated by $N_{(E1-E2))}$ is determined, as is the difference in rank between item E2 and item E2 (indicated by $N_{(E2-E3)}$). In step 40', these differences are compared with a threshold value N. More particularly, if $N_{(E1-E2)}$ is greater than N and if $N_{(E2-E3)}$ is less than N, the filling level of the sort-outlet tray is determined early in step 44 by adding the thicknesses of the items E2 and E3 that are stored in a memory in step 25. Then, in step 45, the filling level (determined in step 44) is compared with the third threshold S3, and if the filling level is greater than S3, the tray in the sort outlet is caused to be changed (step 37) after the current item E1 has been deposited in it. Otherwise, the process continues at step 31 for a new current item. Predictive tray-change management is thus performed in steps 39', 40', 44 and 45.

In which case, it is known that it is possible to change the tray without it overflowing between the items E1 and E2, whereas if said tray is changed after E2, it will overflow, and, since it is computed that it is impossible to store item E3 in the tray, the tray is changed after item E1 rather than having to change it after item E2.

If the answer to the test of step 40' is "no", the process continues at step 31 for a new current item.

Naturally, the computations and forecasts on the tray changes can be made in advance even before the second sorting pass starts, given that the pass sequence for the items in the second sorting pass is known, as are their addresses and thicknesses. However, making such forecasts in real time makes it possible to appraise better any contingency that might occur during the sorting process.

The method of the invention is not limited to carrousel sorting machines but rather it can be implemented in any postal sorting machine.

What is claimed is:

1. A method of sorting postal items in a plurality of sorting passes in a sorting machine having sort outlets with removable trays for storing the items, said method comprising the following steps, after a first sorting pass during which sorted items are stored in the trays:

in determining and storing in a memory the pass sequence in which the items are to pass through the sorting machine for a subsequent sorting pass, while a current item to be directed towards a sort-outlet is passing;

determining a difference in rank which is the number of items in said pass sequence between the current item and a next item immediately following the current item and that is to be directed to the same sort-outlet tray as the current item; and comparing said difference with a threshold for causing said sort-outlet tray to be replaced with an empty tray.

2. The method according to claim 1, in which, during the subsequent sorting pass, the difference in rank between the next item following the current item and an item immediately following the next item and that is to be directed to the same soft-outlet tray as the current item or as the next item is determined, and said difference is compared with said threshold for causing said soft-outlet tray to be replaced with an empty tray.

3. The method according to claim 1, in which, during the first sorting pass, the thickness of each item is measured and recorded, and in which, during the subsequent sorting pass, the filling levels in the trays are monitored on the basis of the thickness data.

4. The method according to claim 1, in which the filling level of a sort-outlet tray is determined while the current item is passing and if the filling level is greater than a first threshold, the soft-outlet tray is caused to be replaced with an empty tray, and if the filling level is greater than a second threshold that is less than the first threshold, the difference in rank between the current item and the next item following the current item in the pass sequence is determined.

5. The method according to claim 4, in which, in addition, the filling level of the tray with the next item following the current item is determined, and said filling level is compared with a third threshold that is greater than the first threshold so as to cause said sort-outlet tray to be replaced with an empty tray.

6. A postal sorting machine for sorting postal items in a plurality of sorting passes, said sorting machine having sort outlets with removable trays for storing the items, said machine further comprising:

means for determining and storing in a memory, after a first sorting pass during which sorted items are stored in the trays, the pass sequence in which the items are to pass through the sorting machine for a subsequent sorting pass, while a current item to be directed towards a sort-outlet is passing;

means for determining a difference in rank which is the number of items in said pass sequence between the current item and a next item immediately following the current item and that is to be directed to the same sort-outlet tray as the current item; and means for comparing said difference with a threshold for causing said sort-outlet tray to be replaced with an empty tray.

* * * * *